US005993024A

United States Patent [19]

Tseng

[11] Patent Number: 5,993,024

[45] Date of Patent: Nov. 30, 1999

[54] LIGHT FIXTURE HAVING DRAIN GROOVES

[76] Inventor: Jeou-Nan Tseng, No. 539, Sec. 4, Chunghua Rd., Hsinchu, Taiwan

[21] Appl. No.: 09/110,712

[22] Filed: Jul. 7, 1998

[51] Int. Cl.[6] ..... H01R 33/00; F21V 21/00

[52] U.S. Cl. ..... 362/226; 362/249; 362/806

[58] Field of Search ..... 362/226, 249, 362/252, 391, 806

[56] References Cited

U.S. PATENT DOCUMENTS

| | | | |
|---|---|---|---|
| 5,605,395 | 2/1997 | Peng | 362/226 |
| 5,707,138 | 1/1998 | Pan | 362/226 |
| 5,709,457 | 1/1998 | Hara | 362/249 |

*Primary Examiner*—Cassandra Spyrou
*Assistant Examiner*—Darren E. Schuberg
*Attorney, Agent, or Firm*—Hedman, Gibson & Costigan, P.C.

[57] ABSTRACT

A light fixture includes a base having a recess defined in the top thereof and a first passage defined through the base and communicating with the recess. Two first holes are defined through the bottom and communicate with the outside of the base. A socket has a head portion inserted in the recess and a shank portion which extends from the underside of the head portion and inserted in the first passage. A shoulder portion is defined in the underside of the head portion and abuts the shank portion, and a second passage defined through the socket so as to receive a light therein. Two second holes are defined through the shoulder portion and communicate with the two first holes so that moisture or water in the recess or the socket will drain from the first holes and the second holes.

7 Claims, 4 Drawing Sheets

LIGHT FIXTURE HAVING DRAIN GROOVES

FIELD OF THE INVENTION

The present invention relates to a light fixture, and more particularly, to a light fixture having drain grooves.

BACKGROUND OF THE INVENTION

A conventional light fixture for a Christmas light is shown FIG. 6 and includes a base 50 to which a socket 56 is attached to the top portion thereof, the Christmas light 58 is then installed in the socket 56. The base 50 has a recess 52 defined in the top portion thereof so as to install the socket 56 therein and a passage 54 is defined through the base 50 from the bottom of the base 50 to the recess 52 so that a shoulder portion 520 is defined between the passage 54 and the recess 52, and the socket 56 is supported by the shoulder portion 520. When the Christmas light 58 is installed in the socket 56, two wires 582 from the Christmas light 58 extend through the passage 54 to connect to electrical parts (not shown) so as to form a circuit. Such Christmas lights 58 are connected in series so as to wind around a tree or other objects so that all the light fixtures are exposed to the weather. The interior of the socket 56 and the base could be wet by rain drops or dew which could result in a short circuit of the Christmas lights.

The present invention intends to provide a light fixture which has a drain hole defined through the socket and the base so that water or moisture will not be retrained therein. The light fixture effectively improves the shortcomings of the conventional light fixture.

SUMMARY OF THE INVENTION

In accordance with one aspect of the present invention, a light fixture is provided comprising a base having a recess defined in the top thereof and a first passage defined through the base and communicating with the interior of the recess via an aperture defined through the bottom defining the recess. A shoulder portion is defined on the bottom and located between the inner periphery defining the recess and the periphery defining the aperture. The shoulder portion has at least one first hole defined therethrough which communicates with the outside of the base. A socket has a head portion to insert in the recess of the base and a shank portion which extends from the underside of the head portion and is received in the first passage. A shoulder portion is defined in the underside of the head portion and abuts the shank portion. A second passage is defined through the socket so as to install a light therein. At least one second hole is defined through the shoulder portion and communicates with the at least one first hole. Therefore water will not be retained in the base or the socket.

An object of the present invention is to provide a light fixture in which water such as rain drops or dew will not be retained.

Further objects, advantages, and features of the present invention will become apparent from the following detailed description with appropriate reference to the accompanying drawings.

DETAILED DESCRIPTION OF THE PREFERRED EMBODIMENTS

Figure 2:
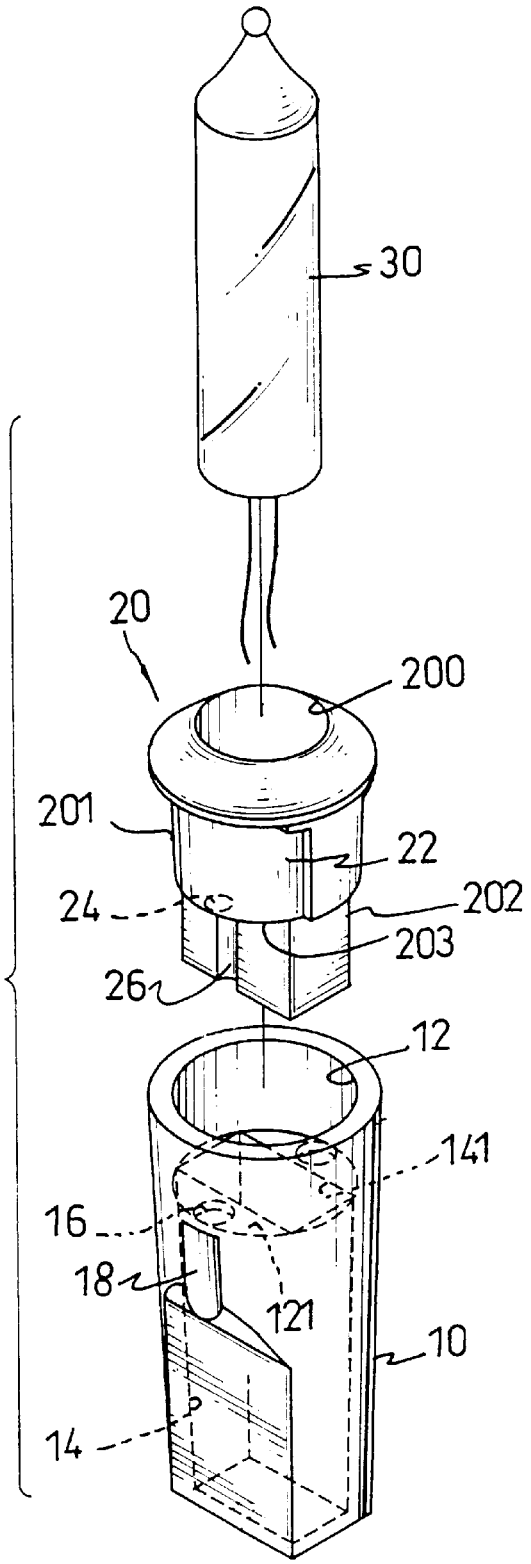
FIG. 2 is an exploded view of the light and the light fixture in accordance with the present invention.
Figure 1:
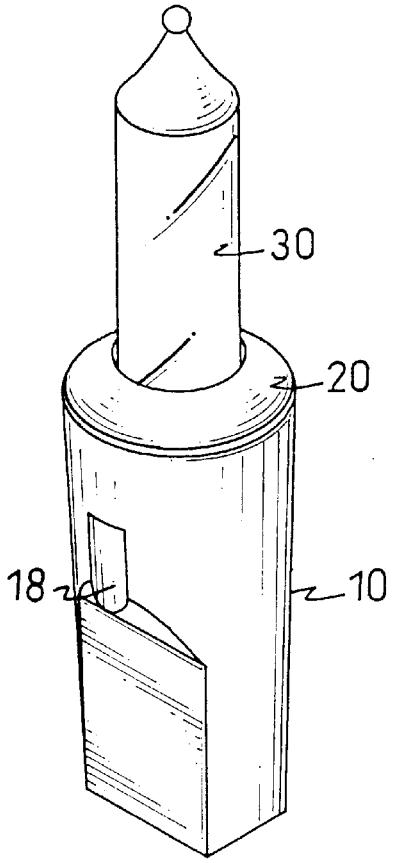
FIG. 1 is a perspective view of a light installed in a light fixture in accordance with the present invention.

Referring to FIGS. 1 through 4, a light fixture comprises a base 10 having a recess 12 defined in a top thereof and a first passage 14 defined through the base 10 and communicating with the interior of the recess 12 via an aperture 141 defined through the bottom defining the recess 12. A shoulder portion 121 is defined on the bottom and located between the inner periphery defining the recess 12 and the periphery defining the aperture 141. The shoulder portion 121 has two first holes 16 defined therethrough which communicate with the outside of the base 10. Two first grooves 18 are respectively defined in the outer periphery of the base 10 and communicate with the two first holes 16.

Figure 3:
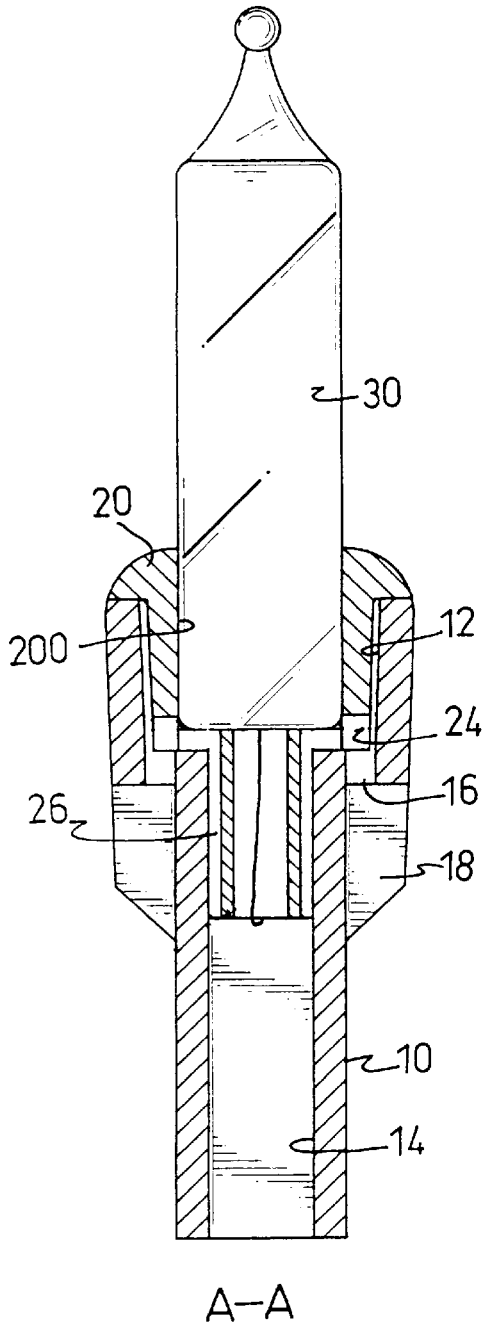
FIG. 3 is a side elevational view, partly in section, of the light installed in the light fixture in accordance with the present invention.
Figure 4:
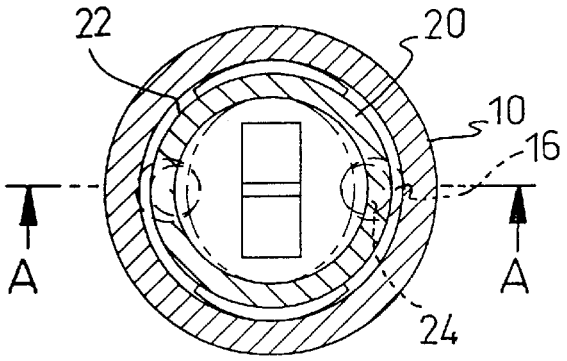
FIG. 4 is a top cross-sectional view to show the positions of the first holes and the second holes in the light fixture of the present invention.

The socket 20 has a head portion 201 which is inserted in the recess 12 of the base 10 and a shank portion 202 which extends from the underside of the head portion 201 and is inserted in the first passage 14. The head portion 201 has two recesses 22 defined in the peripheral wall thereof so that when the head portion 201 is inserted in the recess 12, two gaps are defined between the inner periphery defining the recess 12 and the head portion 201 as shown in FIG. 3 and respectively communicate with the two first holes 16 so as to prevent the second holes 24 from being blocked. A shoulder portion 203 is defined in the underside of the head portion 201 and abuts the shank portion 202 so that when the head portion 20 of the socket 20 is inserted in the recess 12, the shoulder portion 203 rests on the shoulder portion 121. A second passage 200 is defined through the socket 20 so as to install a light 30 therein. Two second holes 24 are respectively defined through the shoulder portion 203 and communicate with the first holes 16 respectively. Two second grooves 26 are respectively defined in the outer periphery of the shank portion 202 and communicate with the two second holes 24 so that the two second grooves 26 communicate with the passage 14 when the socket 20 is installed in the base 10.

Figure 5:
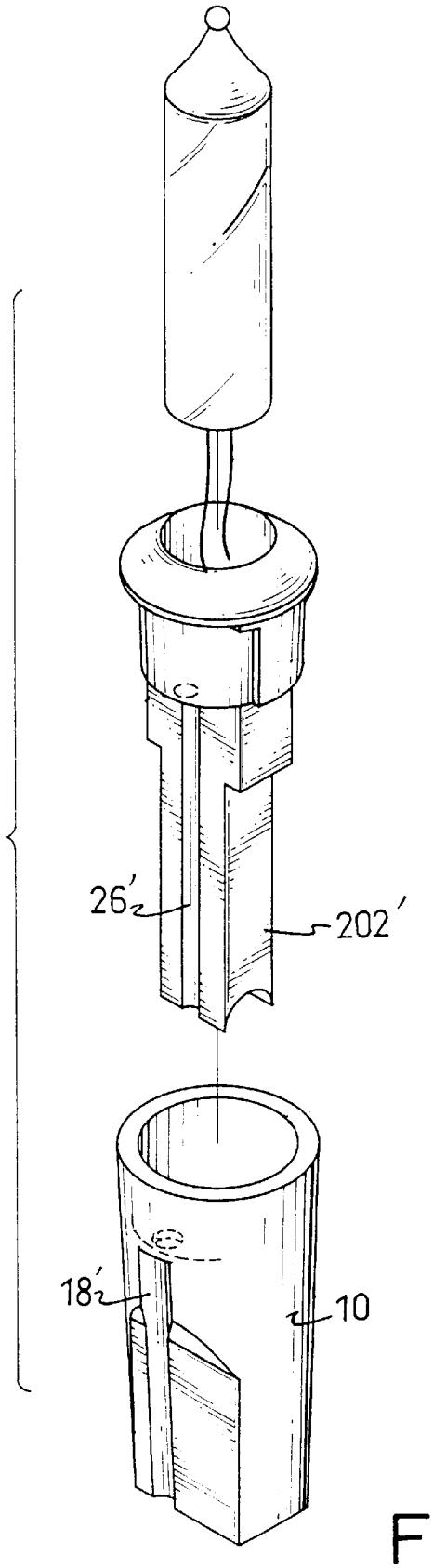
FIG. 5 is an exploded view of the light and another embodiment of the light fixture in accordance with the present invention.
Figure 6:
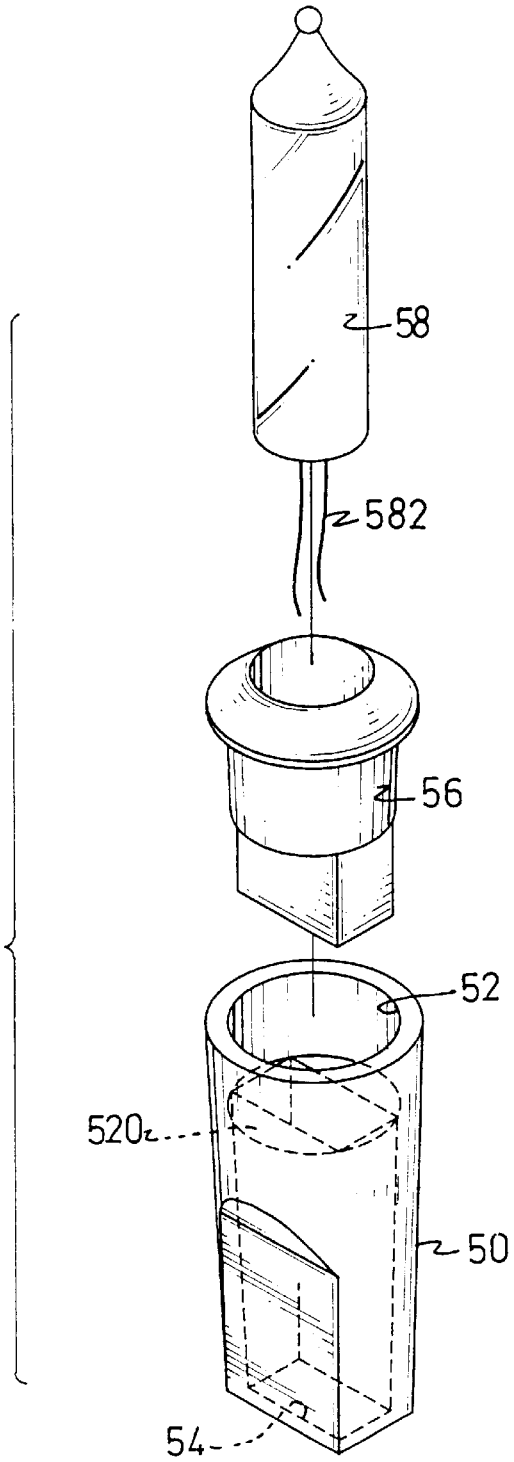
FIG. 6 PRIOR ART
FIG. 6 is an exploded view of a light and a conventional light fixture.

FIG. 5 shows another embodiment of the light fixture wherein the length of the shank portion 202' is longer than the length of the shank portion 202 shown in FIG. 2 and the second grooves 26' (only one is shown) is defined in the outer periphery thereof. Similarly, the length of the first grooves 18' (only one is shown) are further extended to the lower end of the base 10.

Accordingly, water, rain drops or dew will not be retained in the light fixture and will drain from the device via the first holes 16 and/or the second holes 24 so as to effectively improve the shortcomings of the conventional light fixture.

Although the invention has been explained in relation to its preferred embodiment, it is to be understood that many other possible modifications and variations can be made without departing from the spirit and scope of the invention as hereinafter claimed.

What is claimed is:

1. A light fixture comprising:

a base having a recess defined in the top thereof and a first passage defined through said base and communicating with the interior of said recess via an aperture defined through the bottom defining said recess, a shoulder portion defined on said bottom and located between the inner periphery defining said recess and the periphery defining said aperture, said shoulder portion has at least one first hole defined therethrough which communicates with the outside of said base, and a socket having a head portion inserted in said recess and a shank portion which extends from the underside of said head portion and is inserted in said first passage, a shoulder portion defined in said underside of said head portion and abutting said shank portion, a second passage defined through said socket so as to be adapted to receive a light therein, and at least one second hole defined through said shoulder portion and communicating with said at least one first hole.

2. The light fixture as claimed in claim 1, wherein said head portion has two recesses defined in the peripheral wall thereof.

3. The light fixture as claimed in claim 2 further comprising two gaps defined between said inner periphery defining the recess and the head portion.

4. The light fixture as claimed in claim 3, wherein at least one of said two gaps communicates with said at least one first hole.

5. The light fixture as claimed in claim 1 further comprising at least one first groove defined in the outer periphery of said base and communicating with said at least one first hole.

6. The light fixture as claimed in claim 1 further comprising at least one second groove defined in the outer periphery of said shank portion and communicating with said at least one second hole.

7. The light fixture as claimed in claim 6, wherein at least one of said second grooves communicates with said first passage when said socket is inserted in said base.

* * * * *